US008579286B2

(12) United States Patent
Hirai et al.

(10) Patent No.: US 8,579,286 B2
(45) Date of Patent: Nov. 12, 2013

(54) IMAGE RECORDING DEVICE

(75) Inventors: Keisuke Hirai, Kyoto (JP); Akira Murata, Kyoto (JP); Kouichi Ueno, Kyoto (JP)

(73) Assignee: Dainippon Screen Mfg. Co., Ltd. (JP)

( * ) Notice: Subject to any disclaimer, the term of this patent is extended or adjusted under 35 U.S.C. 154(b) by 612 days.

(21) Appl. No.: 12/936,118

(22) PCT Filed: Aug. 25, 2009

(86) PCT No.: PCT/JP2009/004093

§ 371 (c)(1),
(2), (4) Date: Oct. 1, 2010

(87) PCT Pub. No.: WO2010/023879

PCT Pub. Date: Mar. 4, 2010

(65) Prior Publication Data

US 2012/0120464 A1 May 17, 2012

(30) Foreign Application Priority Data

Aug. 27, 2008 (JP) ..... 2008-218120

(51) Int. Cl.
*B65H 7/02* (2006.01)

(52) U.S. Cl.
USPC ..... 271/265.01; 271/258.01; 271/186

(58) Field of Classification Search
USPC ..... 271/301, 184–186, 266, 256, 258.01, 271/264, 265.01; 399/401, 364
See application file for complete search history.

(56) References Cited

U.S. PATENT DOCUMENTS

| | | | | |
|---|---|---|---|---|
| 5,974,298 | A | 10/1999 | Urban et al. | |
| 2003/0077095 | A1 | 4/2003 | Conrow | |
| 2006/0050126 | A1 * | 3/2006 | Tanaka et al. | 347/104 |
| 2006/0177254 | A1 * | 8/2006 | Mihara | 399/401 |
| 2007/0194034 | A1 | 8/2007 | Vasiadis | |
| 2011/0268484 | A1 * | 11/2011 | Aoi | 399/397 |

FOREIGN PATENT DOCUMENTS

| | | |
|---|---|---|
| EP | 2 191 972 | 6/2010 |
| JP | 2003-207954 | 7/2003 |
| JP | 2006-89204 | 4/2006 |
| JP | 2006-103969 | 4/2006 |
| JP | 2006-218710 | 8/2006 |
| JP | 2006-263971 | 10/2006 |
| JP | 2008-536718 | 9/2008 |

OTHER PUBLICATIONS

European Search Report for EP 09 80 9535 dated Jul. 9, 2013.

* cited by examiner

*Primary Examiner* — Prasad Gokhale
(74) *Attorney, Agent, or Firm* — Ostrolenk Faber LLP

(57) ABSTRACT

An image recording device that makes it possible to accurately position images on the front and reverse surfaces of a recording medium even when there is an error in length in the direction of conveyance of the recording medium. The image recording device is equipped with a paper supply part, a paper discharge part, a table movement mechanism, which moves ten tables disposed at regular intervals along a circulation path, an image recording part, which records an image on printing paper on top of the table that is moved by this table movement mechanism, an inversion part, which inverts the printing paper, and a transport mechanism, which transports the printing paper inverted by the inversion part to the paper supply part.

8 Claims, 28 Drawing Sheets

IMAGE RECORDING DEVICE

CROSS-REFERENCE TO RELATED APPLICATION

The present application is a 35 U.S.C. §371 national phase conversion of PCT/JP2009/004093 filed Aug. 25, 2009, which claims benefit and priority of Japanese Patent Application No. JP2008-218120 filed Aug. 27, 2008, both incorporated herein in their entirety.

TECHNICAL FIELD

The present invention relates to an image recording device that records images on front and reverse surfaces of a recording medium that moves with being held by recording medium holding means.

BACKGROUND ART

A conventional typical web press employs a configuration in which, by using an inverting drum to invert a sheet of printing paper, images are printed on front and reverse surfaces of the sheet of printing paper. Also, in recent years, there is proposed an image recording device that enables high-mix low-volume production by using an inkjet image recording device to discharge ink on a recording medium transported by transport means, or another means. Even such an image recording device employs a configuration in which images are recorded on front and reverse surfaces of the recording medium (see Patent literatures 1 to 3).

CONVENTIONAL TECHNIQUE LITERATURE

Patent Literatures

Patent literature 1: JP2006-89204A
Patent literature 2: JP2006-103969A
Patent literature 3: JP2003-207954A

SUMMARY OF THE INVENTION

Problem to be Solved by the Invention

In the case of recording images on front and reverse surfaces of a recording medium that moves with being held by recording medium holding means, in order to easily invert the recording medium, by using a switch back type inversion part that inverts the recording medium on the basis of a switch back method such that a front end of the transported recording medium serves as a back end, the recording medium can be surely inverted even with a simple device configuration.

However, in the case of using such a switch back type inversion part, differently from inversion for the case of using the inverting drum in the conventional typical web press, the front end and back end of the recording medium are replaced by each other. For this reason, if there is an error in length in the direction of conveyance of the recording medium, the images on the front and reverse surfaces of the recording medium are shifted in position.

The present invention is made to solve the above-described problem, and has an object to provide an image recording device that makes it possible to accurately position images on the front and reverse surfaces of a recording medium even when there is an error in length in the direction of conveyance of the recording medium.

Means Adapted to Solve the Invention

A first aspect of the present invention is an image recording device that records images on a front surface and a reverse surface of a recording medium, the image recording device including: recording medium holding means that holds the recording medium; a movement mechanism that moves the recording medium holding means; a recording medium attachment part that attaches the recording medium to the recording medium holding means that is moved by driving by the movement mechanism; a recording medium supply part that supplies the recording medium not recorded with an image to the recording medium attachment part; a recording head that records an image on the recording medium that is attached to the recording medium holding means by the recording medium attachment part and held by the recording medium holding means; a detection part that detects a size of the recording medium of which the front surface is recorded with the image by the recording head; an inversion part that inverts, on a basis of a switch back method, the recording medium of which the front surface is recorded with the image by the recording head, such that a front end of the recording medium serves as a back end; a recording medium transport mechanism that transports the recording medium inverted by the inversion part to the recording medium attachment part; a control part that adjusts, on a basis of the size of the recording medium, the size being detected by the detection part, an image recording position on the reverse surface of the recording medium by the recording head; and a recording medium discharge part that discharges the recording medium of which the front surface and the reverse surface are recorded with the images by the recording head.

According to a second aspect of the present invention, in the first aspect of the present invention, the recording medium holding means is a plurality of tables that support recording media, and the tables move along a circulation path with use of; a pair of roller members; a drive mechanism that rotationally drives the pair of roller members; and an endless transport mechanism that has an endless rope body wound on the pair of roller members.

According to a third aspect of the present invention, in the second aspect of the present invention, the recording medium attachment part alternately attaches to the plurality of tables a recording medium not recorded with an image and a recording medium of which a front surface is recorded with an image.

According to a fourth aspect of the present invention, in the third aspect of the present invention, the recording medium supply part intermittently supplies the recording medium not recorded with an image to the recording medium attachment part; and the recording medium transport mechanism transports, between the recording media not recorded with an image, the recording media being intermittently supplied by the recording medium supply part, the recording medium of which the front surface is recorded with the image.

According to a fifth aspect of the present invention, in the second aspect of the present invention, the recording medium attachment part is provided with a positioning mechanism that comes into abutting contact with a front end of a recording medium to position the recording medium.

According to a sixth aspect of the present invention, in the second aspect of the present invention, the detection part is a scanner that scans the image recorded by the recording head or a detection patch.

According to a seventh aspect of the present invention, in the second aspect of the present invention, the inversion part is arranged in a same direction as the paper discharge part.

According to an eighth aspect of the present invention, in the second aspect of the present invention, the inversion part is arranged in a same direction as the recording medium attachment part, and a stocker part that temporarily stocks a recording medium on which single-surface printing is complete, and a transport mechanism that transports the recording medium temporarily stocked by the stocker part to the recording medium attachment part are disposed adjacent to the inversion part.

Effects of the Invention

According to the first aspect of the present invention, even when there is an error in length in the direction of conveyance of the recording medium, the images on the front and reverse surfaces of the recording medium can be accurately positioned.

According to the second aspect of the present invention, onto surfaces of the tables that are moved along the circulation path by the endless transport mechanism, the recording medium not recorded with an image and the recording medium of which the front surface is recorded with the image can be attached.

According to the third aspect of the present invention, the recording medium not recorded with an image and the recording medium of which the front surface is recorded with the image can be alternately attached onto the tables to preferably perform recording of the image on a front surface of the recording medium and recording of an image on a reverse surface of the recording medium.

According to the fourth aspect of the present invention, the recording medium not recorded with an image and the recording medium of which the front surface is recorded with the image can be alternately attached onto the recording medium holding means to preferably perform recording of the image on a front surface of the recording medium and recording of an image on a reverse surface of the recording medium.

According to the fifth aspect of the present invention, the recording medium can be positioned and accurately attached in the recording medium attachment part.

According to the sixth aspect of the present invention, with use of the scanner that scans the image recorded by the recording head or the detection patch, the size of the recording medium can be detected.

According to the seventh aspect of the present invention, a recording medium after image recording can be selectively transported to the inversion part or the paper discharge part.

According to the eighth aspect of the present invention, the inverted recording medium can be temporarily stocked in the stocker part, and then the recording medium can be again transported to the recording medium attachment part.

EMBODIMENTS OF THE PRESENT INVENTION

Figure 1:
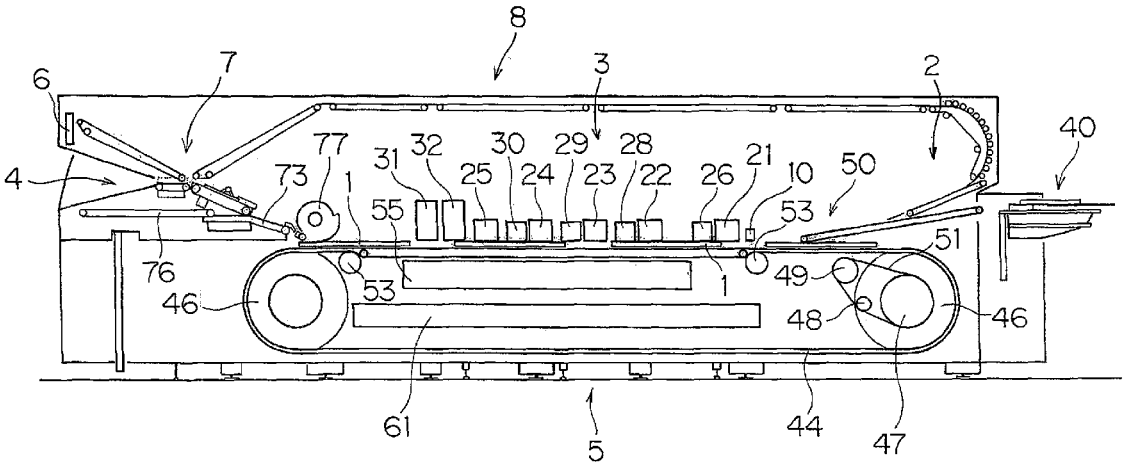
FIG. 1 is a schematic side view of an image recording device according to a first embodiment of the present invention.
Figure 2:
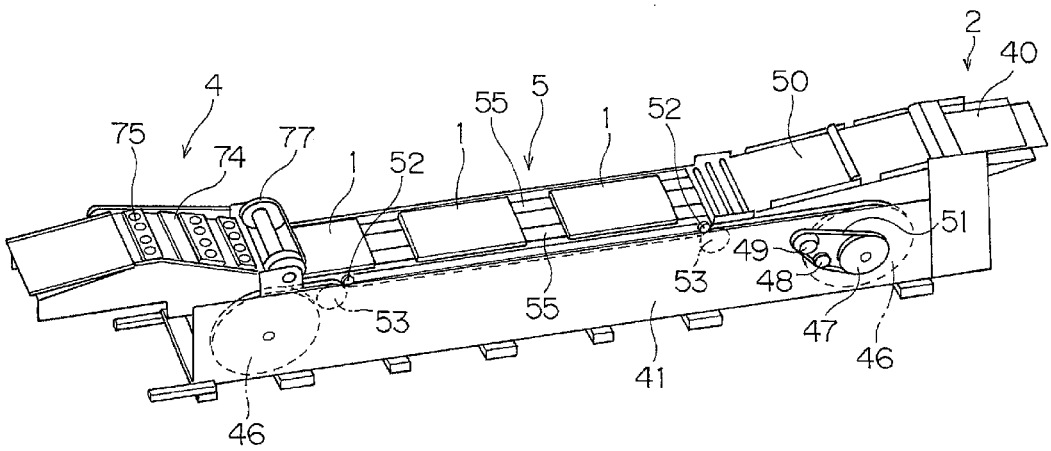
FIG. 2 is a perspective view illustrating the image recording device according to the first embodiment of the present invention with an image recording part 3, an inversion part 7, and a recording medium transport mechanism 8 being removed.

Embodiments of the present invention will hereinafter be described on the basis of the drawings. FIG. 1 is a schematic side view of an image recording device according to a first embodiment of the present invention, and FIG. 2 is a perspective view illustrating the image recording device with an image recording part 3, an inversion part 7, and a recording medium transport mechanism 8 being removed.

The image recording device is one that records an image on a sheet of printing paper as a recording medium suctioned and held on a table 1 with use of a suction hole, and equipped with a paper supply part 2, a paper discharge part 4, a table movement mechanism 5, which moves ten tables 1 (FIGS. 1 and 2 only illustrate parts of them) disposed at regular intervals along a circulation path, an image recording part 3, which records the image on the sheet of printing paper on top of the table 1 that is moved by this table movement mechanism 5, a GUI (Graphical User Interface) 6 having a touch panel type input/output part, an inversion part 7, which inverts the sheet of printing paper, and a transport mechanism 8, which transports the sheet of printing paper inverted by the inversion part to the paper supply part 2.

Figure 3:
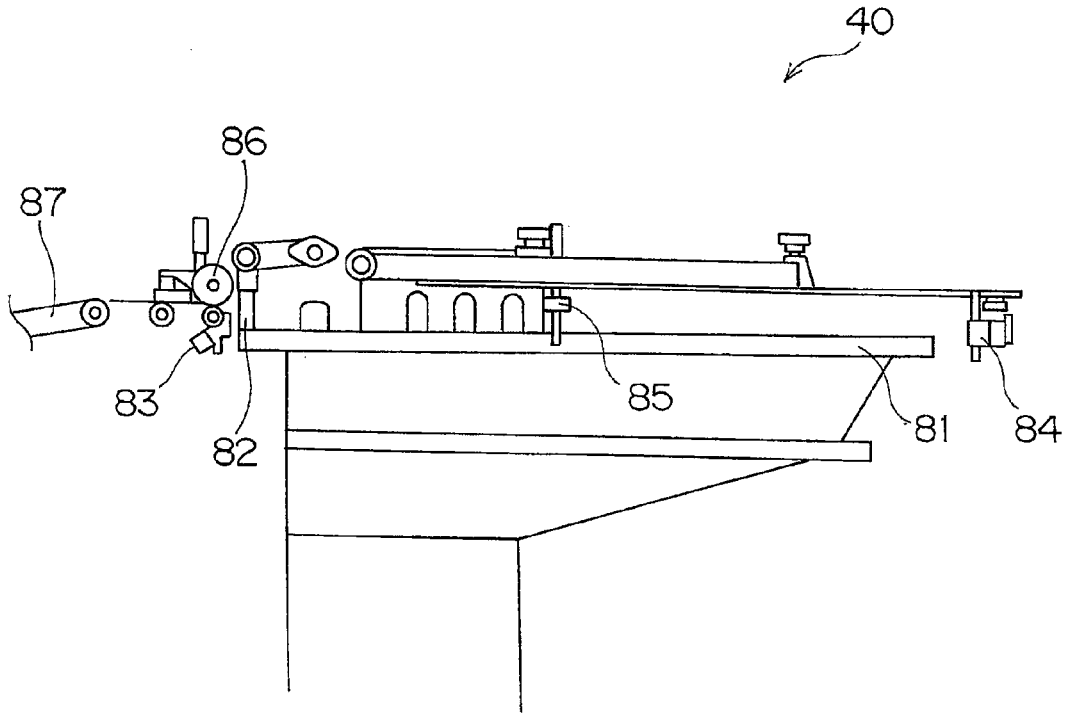
FIG. 3 is a side view of a sucker part 40.
Figure 4:
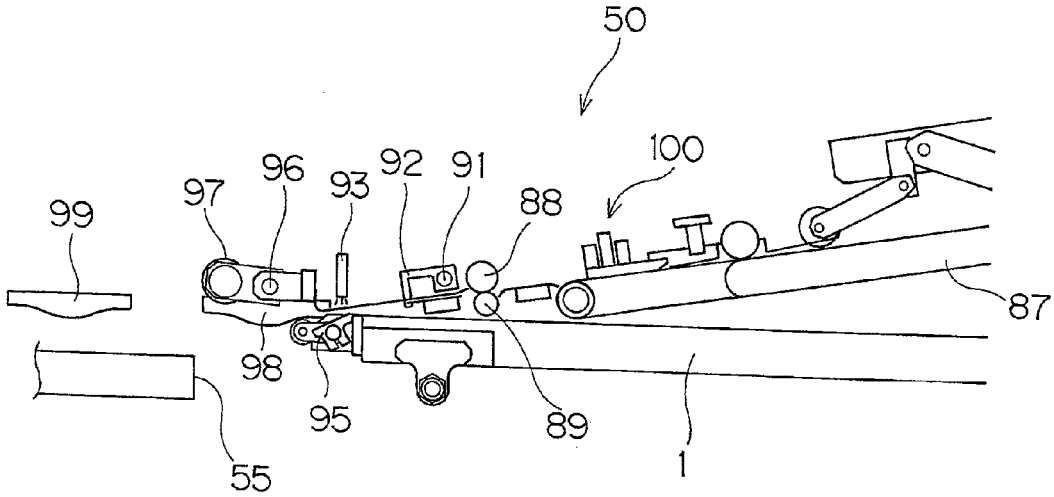
FIG. 4 is a side view illustrating a flow part 50 together with a table 1.
Figure 5:
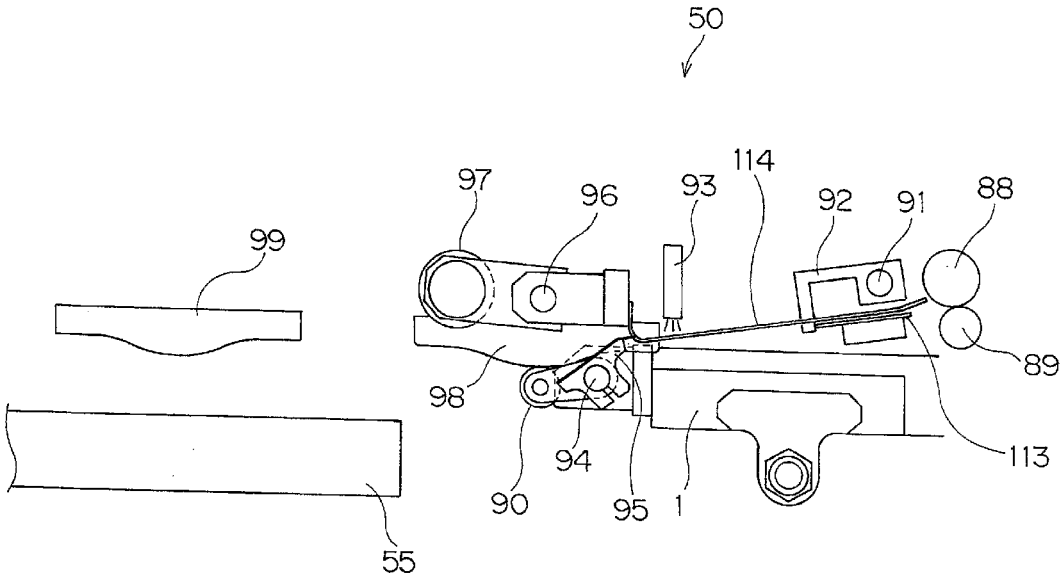
FIG. 5 is an enlarged view of a main part illustrating the flow part 50 together with the table 1.

The paper supply part 2 includes: a sucker part 40 that functions as a recording medium supply part of the present invention; and a flow part 50 that functions as a recording medium attachment part of the present invention. FIG. 3 is a side view of the sucker part 40. Also, FIG. 4 is a side view illustrating the flow part 50 together with the table 1, and FIG. 5 is an enlarged view of a main part of the flow part 50.

As illustrated in FIG. 3, the sucker part 40 is provided with: a paper placement stage 81 that moves up and down with placing a sheet of printing paper thereon; and a paper supply sucker 82 that suctions the sheet of printing paper on the paper placement stage 81 and transports it in the direction of a transport roller 86. The sheet of printing paper transported by the paper supply sucker 82 and the transport roller 86 is transported onto a conveyer 87 of the flow part 50. In addition, around the sheet of printing paper placed on the paper placement stage 81, detaching air blower parts 83, 84, and 85 for preventing double supply at the time of paper supply are disposed.

The flow part 50 is provided with the above-described conveyer 87, a needle mechanism 100, feed rollers 88 and 89, a fore registering part 92, a pair of guide plates 113 and 114, an air discharge nozzle 93, and a squeegee roller 97. Note that the needle mechanism 100 is one that positions the sheet of printing paper, which is transported by the conveyer 87, in a direction orthogonal to a direction of the transport. Also, the fore registering part 92 is one that swings around a shaft 91 to position a front end of the sheet of printing paper transported by the conveyer 87.

The air discharge nozzle 93 is one that, when the sheet of printing paper is attached onto the table 1, blows air toward the front end of the sheet of printing paper. Note that the upper feed roller 88 of the pair of feed rollers 88 and 89 is configured to be movable up and down. Also, the squeeze roller 97 is configured to be swingable around a shaft 96.

At a front end of the table 1 in its moving direction, there is disposed a table pawl 95 for fixing the front end of the sheet of printing paper supplied there to the table 1. The table pawl 95 swings around a shaft 94 provided in the table 1. Note that, on an upstream side of the flow part 50 with respect to the moving direction of the table 1, a pair of cams 98 and 99 for opening/closing the table pawl 95, and a suction fan 55 for suctioning and holding the sheet of printing paper through the table 1 are disposed.

An intersecting angle with respect to the table 1 at the time when the sheet of printing paper is supplied from the flow part 50 to the table 1, i.e., an angle formed between a surface of the table 1 and the pair of guide plates 113 and 114 is preferably as small as possible. The angle is preferably set to 15 degrees or less, and more preferably 10 degrees or less. Note that, in order to make the angle smaller, there is employed a configuration in which the fore registering part 92 is arranged above a movement area of the table 1.

In the flow part 50, the sheet of printing paper sent from the sucker part 40 or after-mentioned transport mechanism 8 is transported by the conveyer 87. At this time, the upper feed roller 88 of the pair of feed rollers 88 and 89 is separated from the lower feed roller 89. Then, the transported sheet of printing paper passes between the pair of feed rollers 88 and 89, and stops when the front end thereof comes into abutting contact with the fore registering part 92. In this state, by action of the needle mechanism 100, the sheet of printing paper transported by the conveyer 87 is positioned in the direction orthogonal to the transport direction.

Then, the feed roller 88 moves down to hold the sheet of printing paper between the pair of feed rollers 88 and 89, and the fore registering part 92 swings and moves up. Subsequently, by action of the pair of feed rollers 88 and 89, the sheet of printing paper is transported toward the table pawl 95 in the table 1. A transport speed of the sheet of printing paper at this time is a speed slightly faster than a moving speed of the table 1. Also, at this time, as illustrated in FIG. 5, along with the movement of the table 1 driven by a linear motor mechanism 61, a cam follower 90 disposed on a side opposite to the table pawl 95 with respect to the shaft 94 comes into abutting contact with the cam 98 for opening/closing the table pawl 95 to thereby bring the table pawl 95 into an open state.

Then, when the front end of the sheet of printing paper reaches the table pawl 95, the table pawl 95 is closed. That is, along with the movement of the table 1, the cam follower 90 disposed on the side opposite to the table pawl 95 with respect to the shaft 94 separates from the cam 98 for opening/closing the table pawl 95 to thereby close the table pawl 95, and the table pawl 95 fixes the sheet of printing paper onto the table 1.

As described, when the table pawl 95 fixes the sheet of printing paper onto the table 1, air is blown to the front end of the sheet of printing paper from the air discharge nozzle 93. For this reason, the sheet of printing paper is pressed against the surface of the table 1, and can be thereby surely fixed between the table pawl 95 and the table 1.

When the table 1 further moves, the sheet of printing paper on the table 1 is squeezed by the squeegee roller 97, and suctioned and held on the table 1 by action of the suction fan 55. Subsequently, the cam follower 90 comes into abutting contact with the second cam 99 for opening/closing the table pawl 95, and thereby the table pawl 95 performs opening/closing operation to resolve distortion of the front end of the sheet of printing paper.

Again referring to FIGS. 1 and 2, the image recording part 3 is one that records, on the basis of an inkjet method, an image on the sheet of printing paper suctioned and held on the upper surface of the table 1 that travels in the one direction by the table movement mechanism 5. The image recording part 3 is provided with a preprocessing agent coating head 21, four recording heads 22, 23, 24, and 25, five heaters 26, 28, 29, 30, and 31, and a scanner 32 functioning as a detection part of the present invention.

The preprocessing agent coating head 21 is one that coats a transparent preprocessing agent on the sheet of printing paper before the four recording heads 22, 23, 24, and 25 record the image. As the preprocessing agent, for example, in the case of using a glossy or glazed sheet of printing paper, an anchor coat is used to improve adhesion of ink onto the sheet of printing paper.

The four recording heads are recording heads 22, 23, 24, and 25 respectively for black, cyan, magenta, and yellow inks. The recording heads 22, 23, 24, and 25 are disposed above the table 1 that moves in the one direction. Each of the recording heads 22, 23, 24, and 25 is provided with a number of inkjet nozzles arranged in a row in the direction orthogonal to the moving direction of the table 1, and from the inkjet nozzles, the inks are discharged onto the sheet of printing paper to record the image.

The five heaters are heater 26 for preheating, heaters 28, 29, and 30 for intermediate heating, and heater 31 for main heating. The heaters 26, 28, 29, 30, and 31 are configured to blow hot air to the sheet of printing paper. Also, the scanner 32 is provided with a linear CCD camera, and configured to measure a size of the sheet of printing paper, and a density of a whole of the recorded image or a patch.

Figure 6:
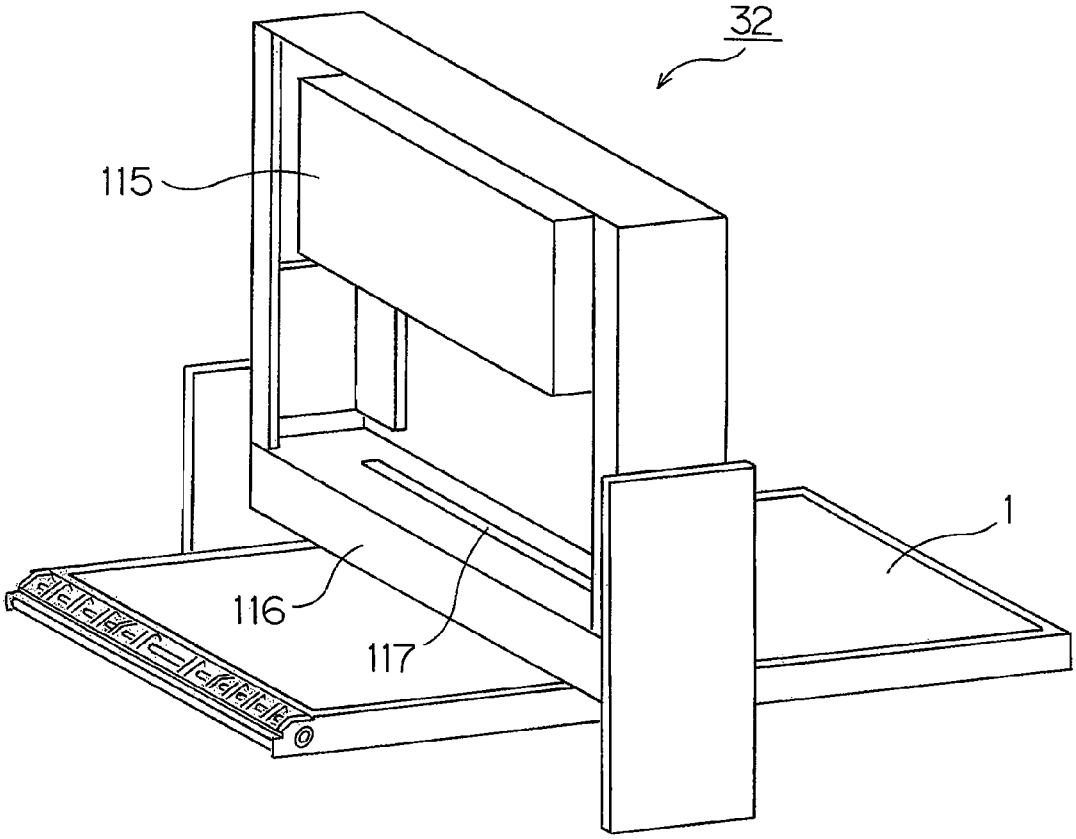
FIG. 6 is a perspective view illustrating a scanner 32 together with the table 1.

FIG. 6 is a perspective view illustrating the scanner 32 together with the table 1.

The scanner 32 also functions as the detection part that detects a size of the sheet of printing paper that is recorded with the image on the surface thereof by the recording heads 22, 23, 24, and 25, and is provided inside thereof with a scan head 115 provided with the linear CCD camera, and an illumination part 116 for illuminating the sheet of printing paper traveling with the table 1. Light that is irradiated from the illumination part 116 and then reflected by the sheet of printing paper and the surface of the table 1 is incident onto the scan head 115 through a slit 117. The scan head 115 takes in the reflected light to thereby measure a density of a whole of the recorded image or the patch, and also detect a size of the sheet of printing paper that is recorded with the image on the front surface thereof.

Again referring to FIGS. 1 and 2, the table movement mechanism 5 is provided with an endless transport mechanism. The endless transport mechanism has a chain 44 wound on a pair of sprockets 46. Also, on a side of one of the sprockets 46, a sprocket 47 is annexed, and the sprocket 47 is connected by a chain 51 to a drive sprocket 48 rotated by motor driving and a driven sprocket 49. For this reason, on the basis of driving by the drive sprocket 48, the chain 44 rotationally moves with being wound on the pair of sprockets 46.

The table movement mechanism 5 is configured to move the ten tables along the circulation path at high speed on the basis of the above-described endless transport mechanism, and upon recording of an image, separate the tables 1 from the endless transport mechanism to accurately move them in the one direction on the basis of the linear motor mechanism 61. At this time, the tables 1 are guided by a rail of a linear guide.

Note that, below a traveling path of the tables 1, the above-described suction fan 55 is disposed. Also, each of the tables 1 has a hollow structure. Further, on the surface of the table 1, the suction hole communicatively connecting to a hollow part of the table 1 is formed. For this reason, by performing exhaust from the suction fan 55, the sheet of printing paper supplied onto the surface of the table 1 can be suctioned and held on the table 1 through the suction hole.

The paper discharge part 4 is provided with: a paper discharging drum 77 that winds the sheet of printing paper on an outer circumferential part thereof to separate it from the table 1; and a plurality of conveyers for transporting the sheet of printing paper received from the paper discharging drum 77.

Figure 7:
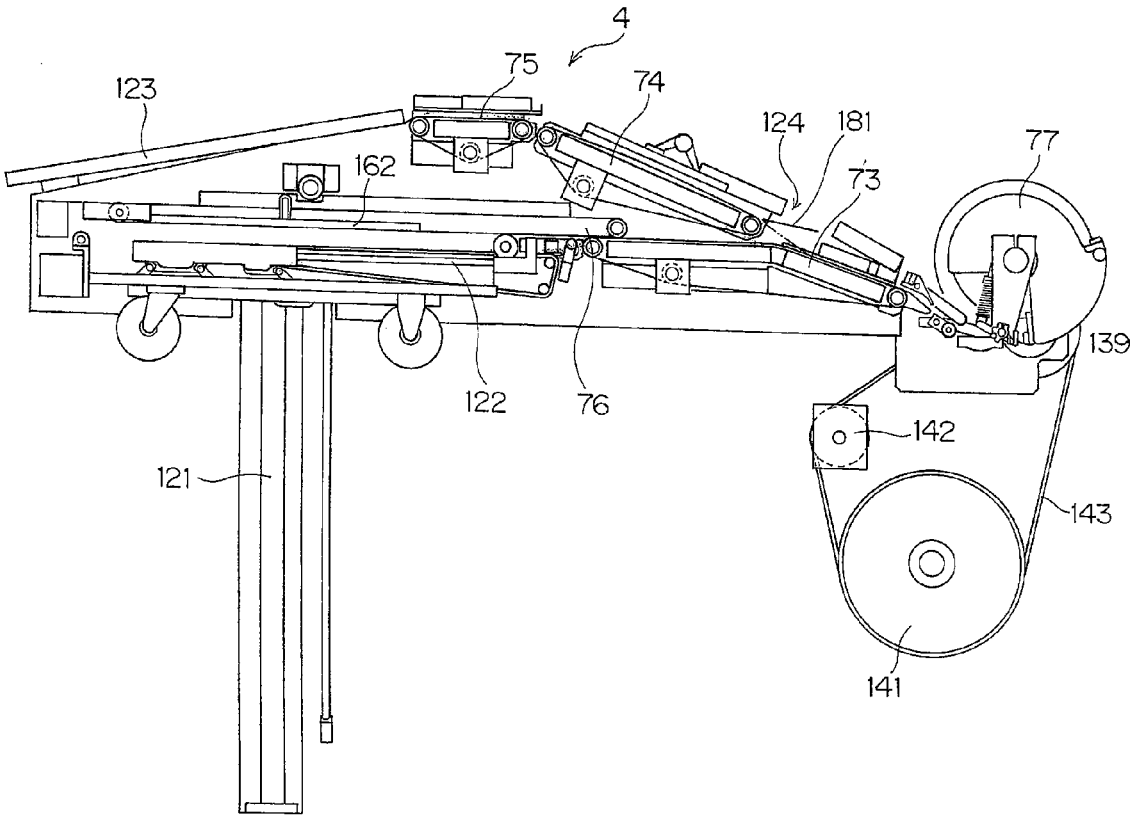
FIG. 7 is a schematic side view of a paper discharge part 4.

FIG. 7 is a schematic side view of the paper discharge part 4.

The paper discharge part 4 is provided with the paper discharging drum 77 that winds the sheet of printing paper on the outer circumferential part thereof to separate it from the table 1. Also, the paper discharge part 4 is provided with: first and second conveyers 73 and 76 that transport the sheet of printing paper received from the paper discharging drum 77 to a stocker part 122 that is guided by a guide 121 to move up and down; third and fourth conveyers 74 and 75 that transport the sheet of printing paper received from the paper discharging drum 77 to a paper discharge table 123; and a transport path switching mechanism 124 provided with a path switching plate 181.

The sheet of printing paper on the table 1 is separated from the table 1 by action of the paper discharging drum 77, and then transported to the first conveyer 73 with being wound on the outer circumferential part of the paper discharging drum 77. Then, the sheet of printing paper is transported with being placed on an upper part of the first conveyer 73, and then transported with being suctioned and held from an upper surface thereof by the second conveyer 76. Subsequently, the sheet of printing paper is released from the suctioning/holding above the stocker part 122, and blown with air from an air blowing tube 162 toward the vicinity of a central part in the direction orthogonal to the transport direction thereof. On the basis of this, the sheet of printing paper is dropped to the stocker part 122 with being double folded around the central part, and collected by the stocker part 122.

Also, in the case of checking by eye the sheet of printing paper having been printed with the image, or transporting the sheet of printing paper to the transport mechanism 8 as will be described later, the switching mechanism 124 arranged on the first conveyer 73 guides the sheet of printing paper, which is being transported by the first conveyer 74, toward the third conveyer 74. In the case of checking the sheet of printing paper by eye, the sheet of printing paper is transported with being placed on upper parts of the third and fourth conveyers 74 and 75, and then discharged onto the paper discharge table 123. Also, in the case of transporting the sheet of printing paper to the transport mechanism 8, the sheet of printing paper is transported to the inversion part 7.

The inversion part 7 arranged above the paper discharge part 4 is one that is intended to invert the sheet of printing paper on the paper discharge part 4 on the basis of a switch back method, and then again transport the sheet of printing paper to the paper supply part 2 through the transport mechanism 8 including a plurality of conveyers.

Figure 12:
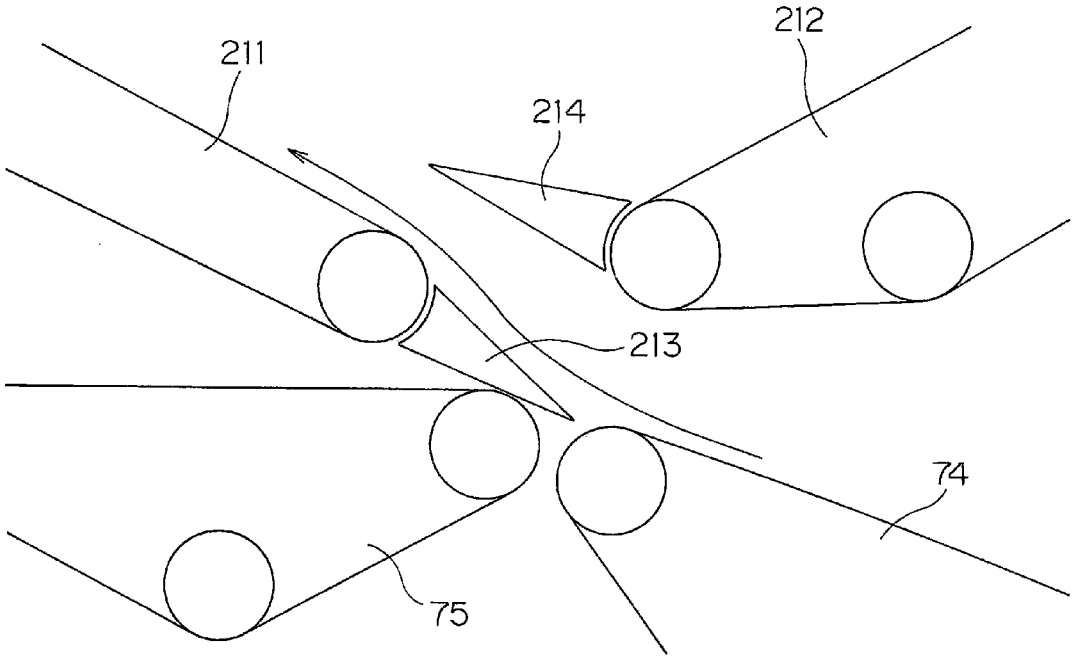
FIG. 12 is an enlarged view of the vicinity of direction switching levers 213 and 214.
Figure 13:
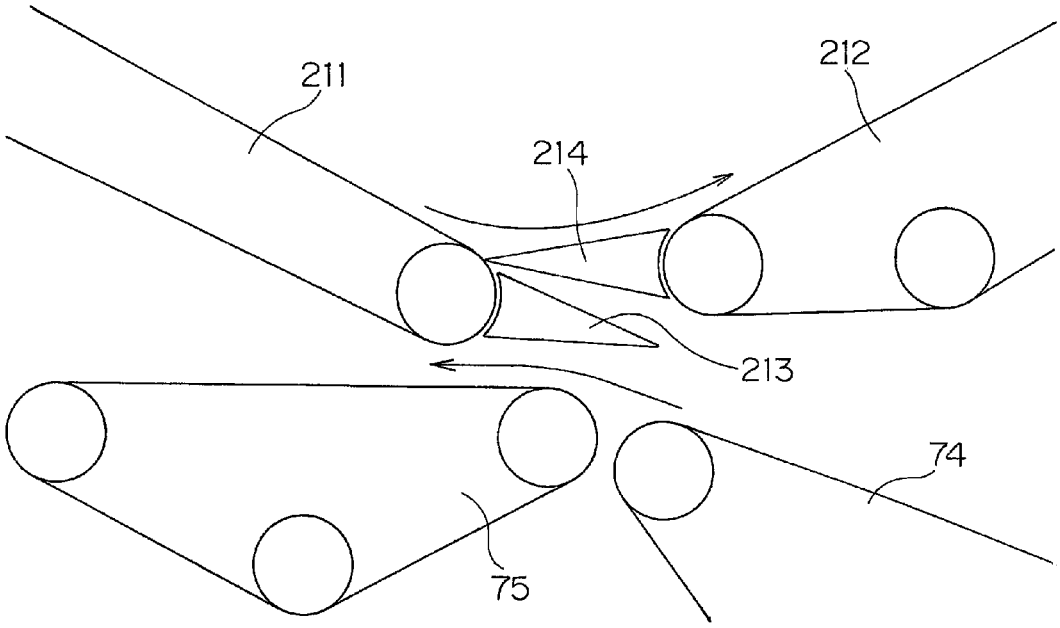
FIG. 13 is an enlarged view of the vicinity of the direction switching levers 213 and 214.

FIGS. 8 to 11 are explanatory diagrams illustrating a configuration of the inversion part 7 and inverting operation by the inversion part 7. Also, FIGS. 12 and 13 are enlarged views of the vicinity of direction switching levers 213 and 214.

The inversion part 7 is provided with fifth and sixth conveyers 211 and 212, and the pair of direction switching levers 213 and 214. The fifth conveyer 211 is one intended to invert a sheet of printing paper a transported by the third conveyer 74 on the basis of the switch back method, and the sixth conveyer 212 is one intended to transport the inverted sheet of printing paper a to the transport mechanism 8. In the following, the inverting operation for the sheet of printing paper a by the inversion part 7 is described.

Figure 8:
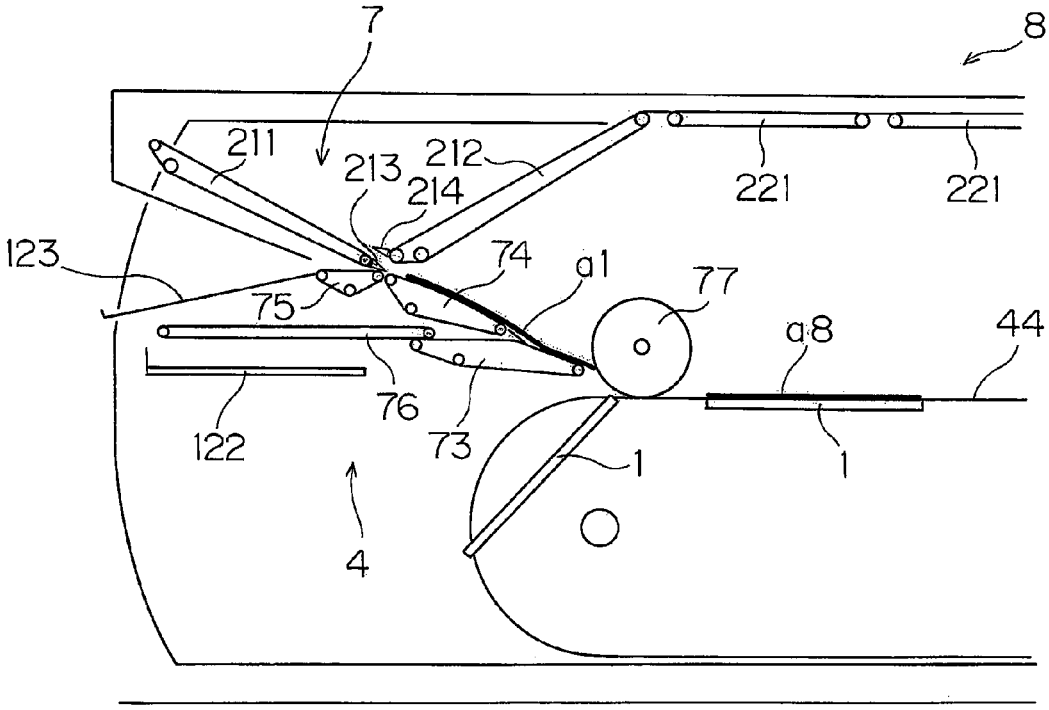
FIG. 8 is an explanatory diagram illustrating a configuration of the inversion part 7 and an inverting operation by the inversion part 7.

As illustrated in FIG. 8, a first sheet of printing paper a1 is separated from the table 1 by the action of the paper discharging drum 77, and then transported by the third conveyer 74. At this time, the direction switching levers 213 and 214 are, as illustrated in FIG. 12, arranged in positions through which the sheet of printing paper a1 is transported from the third conveyer 74 to the fifth conveyer 211.

Figure 9:
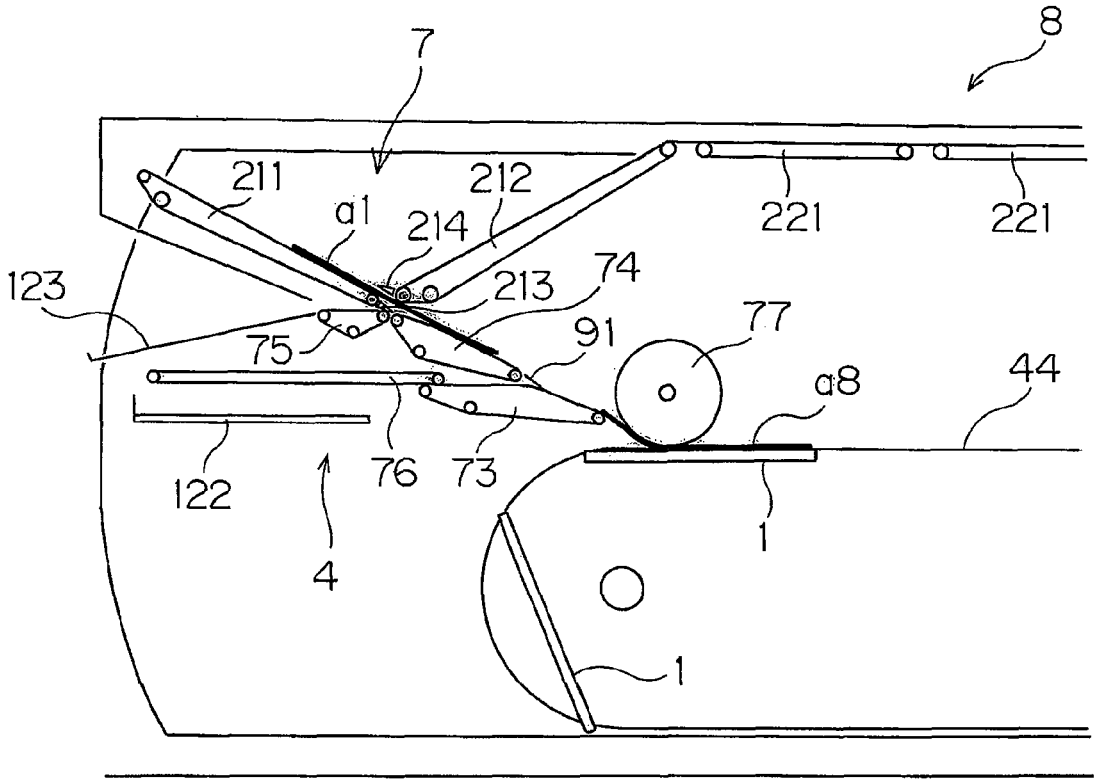
FIG. 9 is an explanatory diagram illustrating the configuration of the inversion part 7 and the inverting operation by the inversion part 7.

For this reason, as illustrated in FIG. 9, the sheet of printing paper a1 is transported from the third conveyer 74 to the fifth conveyer 211. At this time, a next sheet of paper a8 on which reverse surface printing is complete as will be described later is separated from the table 1 by the paper discharging drum 77, and then transported by the first conveyer 73.

Figure 10:
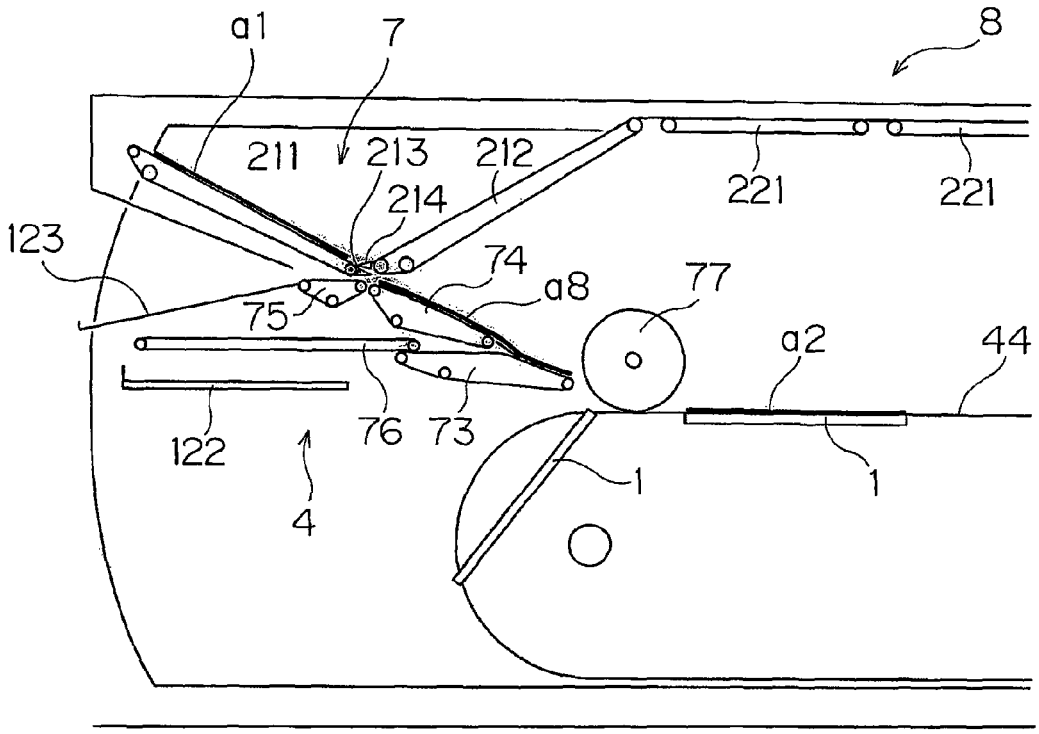
FIG. 10 is an explanatory diagram illustrating the configuration of the inversion part 7 and the inverting operation by the inversion part 7.

As illustrated in FIG. 10, when the sheet of printing paper a1 has been completely transported onto the fifth conveyer 211, the fifth conveyer 211 is stopped. Then, the direction switching levers 213 and 214 are, as illustrated in FIG. 13, arranged in positions through which the sheet of printing paper a1 is transported from the fifth conveyer 211 to the sixth conveyer 212. At this time, the sheet of printing paper transported by the second conveyer 74 is transported toward the fourth conveyer 75. Also, in this state, a next sheet of printing paper a2 is transported by the table 1.

Figure 11:
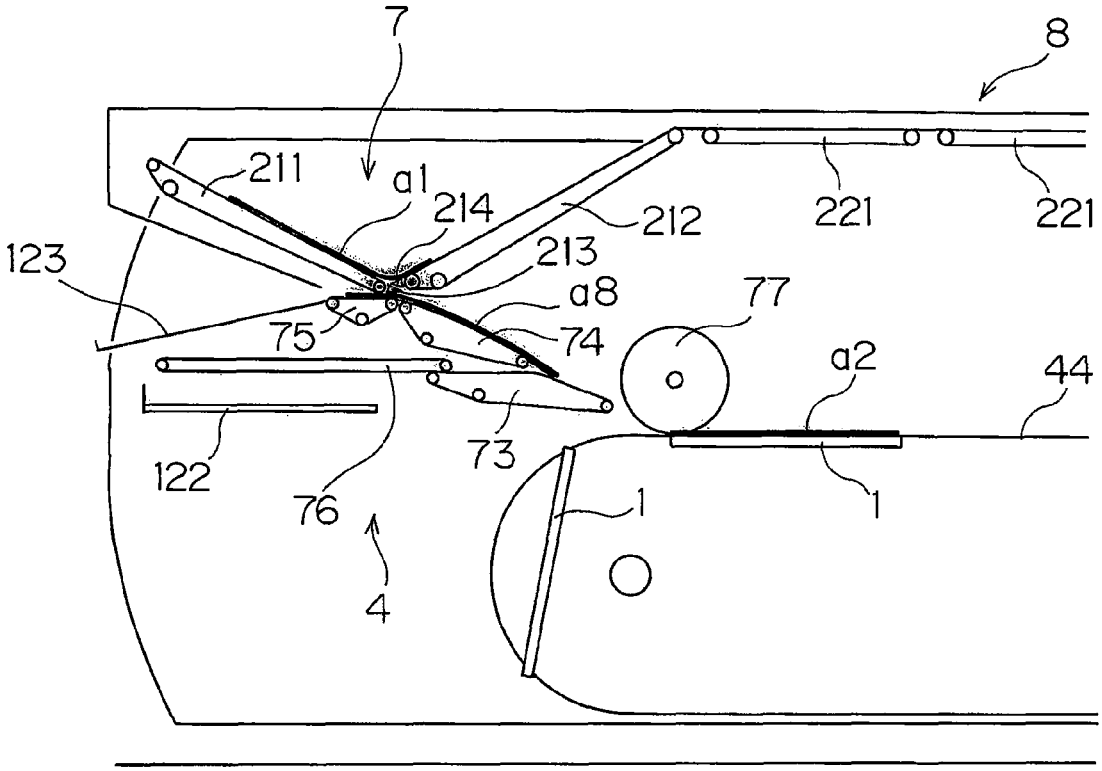
FIG. 11 is an explanatory diagram illustrating the configuration of the inversion part 7 and the inverting operation by the inversion part 7.

Then, as illustrated in FIG. 11, the sheet of printing paper a1 is transported from the fifth conveyer 211 toward the sixth conveyer 212. The sheet of printing paper a1 is transported from the sixth conveyer 212 toward a conveyer 221 of the transport mechanism 8. On the other hand, the next sheet of printing paper a8 is discharged from the fourth conveyer 75 to the paper discharge table 123.

Note that, in the above embodiment, the sheet of printing paper a8 is discharged to the paper discharge table 123 through the fourth conveyer 75. On the other hand, in the case of discharging the sheet of printing paper a8 to the stocker part 122, as described above, it is only necessary to guide the sheet of printing paper a8 from the first conveyer 73 to the second conveyer 76 by the action of the switching mechanism 124.

Figure 14:
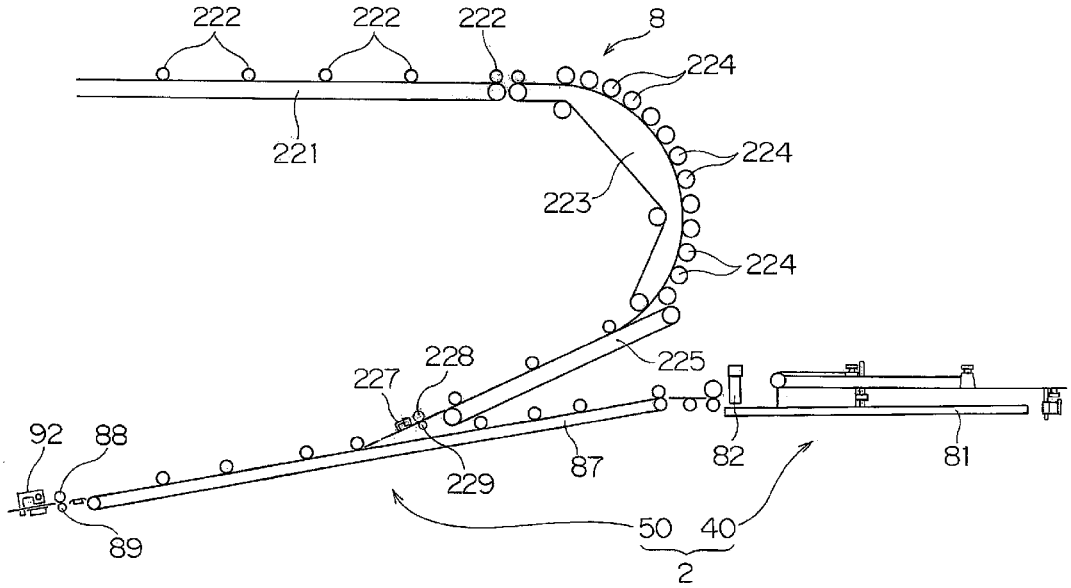
FIG. 14 is a side view illustrating a main part of the transport mechanism 8.
Figure 15:
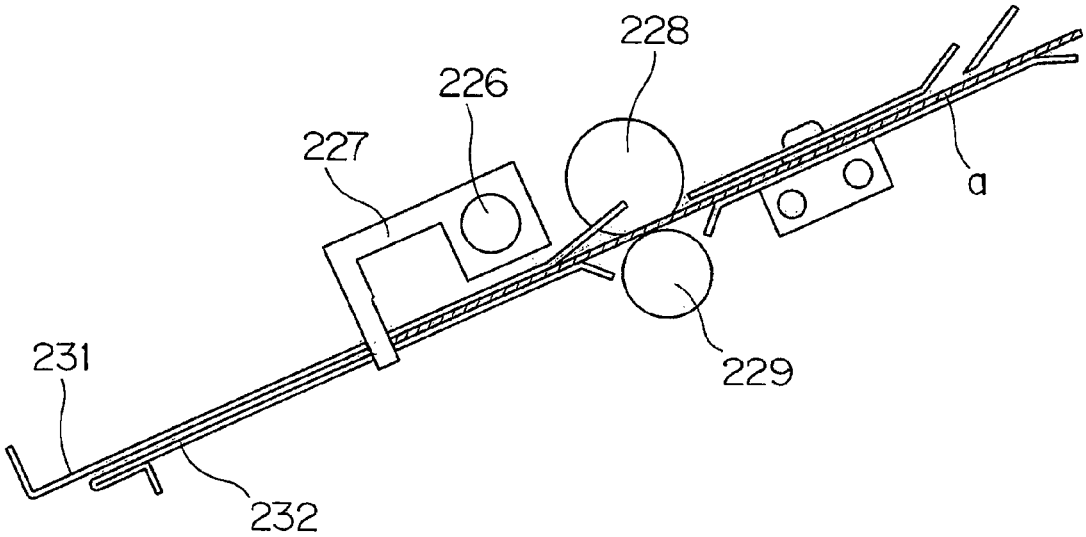
FIG. 15 is an enlarged view of the vicinity of a fore registering part 227 of the transport mechanism 8.

Next, the transport mechanism 8 that transports the sheet of printing paper inverted by the above-described inversion part 7 to the flow part 50 is described. FIG. 14 is a side view illustrating a main part of the transport mechanism 8, and FIG. 15 is an enlarged view of the vicinity of a fore registering part 227 of the transport mechanism 8.

Referring to FIGS. 8 and 14, the transport mechanism 8 is provided with: the plurality of conveyers 221 that horizontally transport the sheet of printing paper a inverted by the inversion part 7; a conveyer 223 that holds the sheet of printing paper a among a number of rollers 224 to invert the sheet of printing paper a; and a conveyer 225 that transports the sheet of printing paper a inverted by the conveyer 223 onto the conveyer 87 of the flow part 50. As illustrated in FIGS. 14 and 15, a front end of the conveyer 225 is disposed with: the fore registering part 227 that comes into abutting contact with a front end of the sheet of printing paper a to position it and a pair of feed rollers 228 and 229. As illustrated in FIG. 15, the fore registering part 227 is swingable around a shaft 226. Also, in the vicinity of the fore registering part 227, a pair of upper and lower guide members 231 and 232 that guide the sheet of printing paper a are disposed.

The sheet of printing paper an inverted by the inversion part 7 is transported by the plurality of conveyers 221, and also positioned in a left-right direction thereof by action of guide members 222. Then, the sheet of printing paper a is further transported by the conveyers 223 and 225; positioned with the front end thereof being in abutting contact with the fore registering part 227; and then stopped. The fore registering part 227 is, as will be described later, released at timing when the sheet of printing paper a positioned by the fore registering part 227 is transported between sheets of printing papers that are intermittently supplied from the sucker part 40 and recorded with no image.

Then, the sheet of printing paper a positioned by the fore registering part 227 is transported by the conveyer 87 of the flow part 50; positioned by the fore registering part 92; then transported toward the table 1; and fixed onto the table 1 by the table pawl 95. On the basis of this, the sheet of printing paper a is attached onto the table 1.

Figure 16:
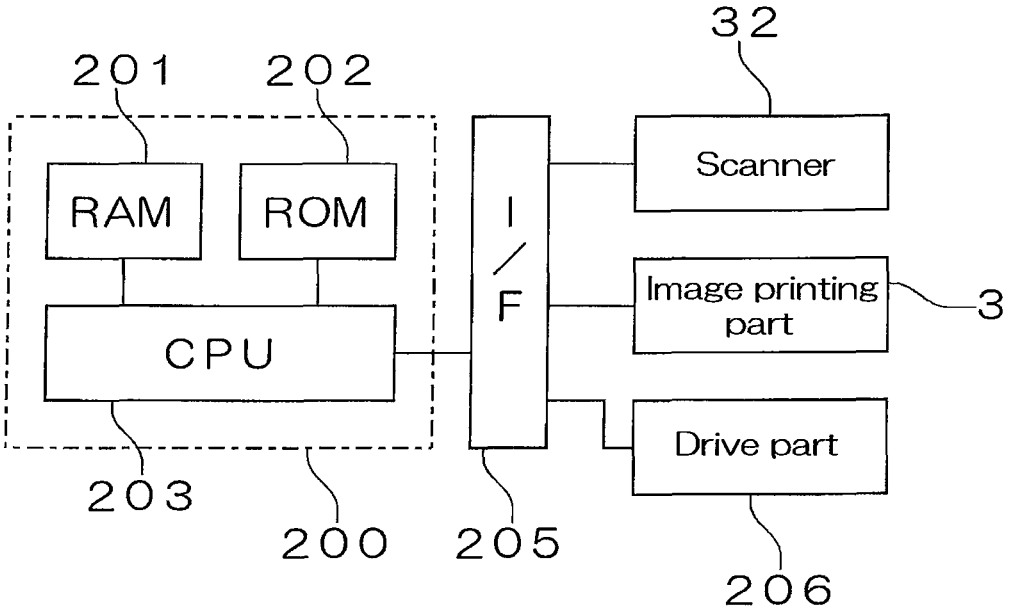
FIG. 16 is a block diagram illustrating a main electrical configuration of the image recording device.

FIG. 16 is a block diagram illustrating a main electrical configuration of the above-described image recording device.

The image recording device is provided with a control part 200 including: a RAM 201 that temporarily stores data or the like upon control; a ROM 202 that stores an operating program necessary for control of the device; and a CPU 203 that performs a logical operation. The control part 200 is connected to the above-described scanner 32 and image recording part 3 through an interface 205. Also, the control part 200 is further connected to a drive part 206 that drives respective parts of the image recording device.

The control part 200 functions as a control part according to the present invention, which adjusts, on the basis of a size of the sheet of printing paper a detected by the scanner 32, an image recording position on a reverse surface of the sheet of printing paper a by the recording heads 22, 23, 24, and 25 in the image recording part 3. That is, in the RAM 201 or ROM 202, a table or the like indicating a relationship between a size of the sheet of printing paper a and an image recording position is recorded. The control part 200 transmits, on the basis of a size of the sheet of printing paper a scanned by the scanner 32, a signal to the image recording part to adjust the image recording position on the reverse surface of the sheet of printing paper by the recording heads 22, 23, 24, and 25.

Next, image recording operation in which images are recorded on both surfaces of the sheet of printing paper a by the image recording device having the above-described configuration is described. FIGS. 17 to 23 are explanatory diagrams schematically illustrating the image recording operation by the image recording device according to the present invention. Note that, in the diagrams, circled symbols a1 to a10 represent sheets of printing paper supplied in this order, and circled numerals 1 to 10 represent tables 1 arranged in this order.

Figure 17:
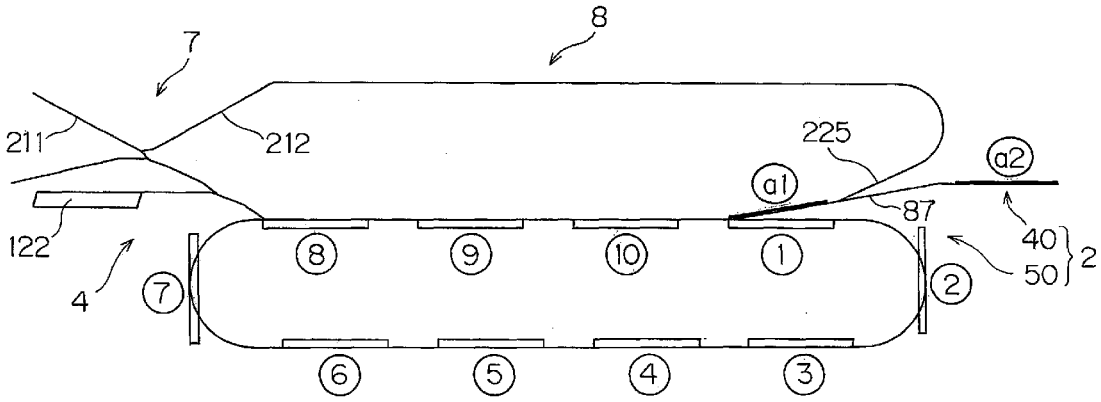
FIG. 17 is an explanatory diagrams schematically illustrating image recording operation by the image recording device according to the present invention.

FIG. 17 illustrates a state where image recording is started. In this state, among the ten tables 1 moved along the circulation path by the endless transport mechanism, a first table 1 is supplied with a first sheet of printing paper a1 from the conveyer 87 of the flow part 50, and the sheet of printing paper a1 is attached onto the first table 1. On the sheet of printing paper a1, an image is recorded by the recording heads 22, 23, 24, and 25 in the image recording part 3. Also, a size of the sheet of printing paper a1 is scanned by the scanner 32. Further, in the sucker part 40, a next sheet of printing paper a2 is prepared for supply. The second sheet of printing paper a2 is attached onto a third table 1 with bypassing a table 1 subsequent to the first table 1 attached with the first sheet of printing paper a1.

Figure 18:
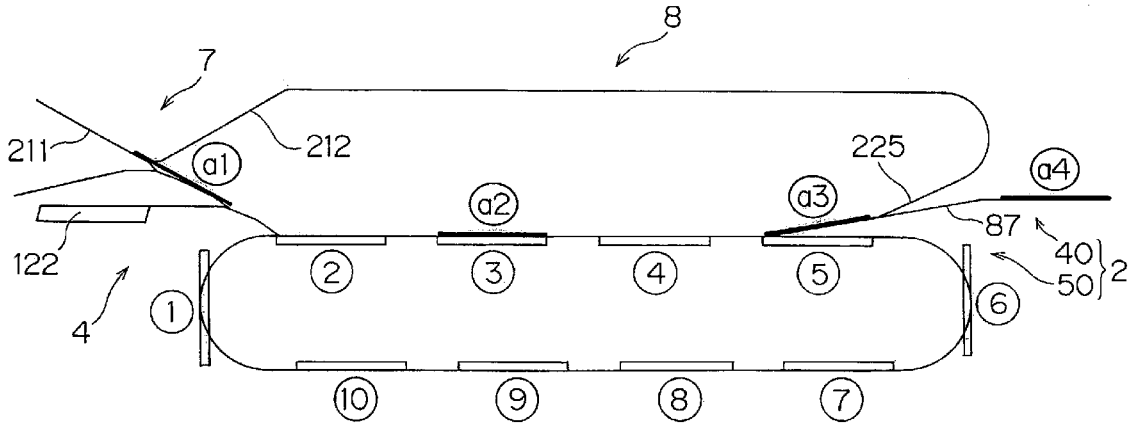
FIG. 18 is an explanatory diagrams schematically illustrating the image recording operation by the image recording device according to the present invention.

Subsequently, when the image recording operation is continued, as illustrated in FIG. 18, the first sheet of printing paper a1 is transported to the fifth conveyer 211 of the inversion part 7. Also, the sheet of printing paper a2 attached onto the third table 1 is recorded with the image by the recording heads 22, 23, 24, and 25 in the image recording part 3. Also, a size of the sheet of printing paper a2 is scanned by the scanner 32. Further, a fifth table 1 is attached with a third sheet of printing paper a3.

Figure 19:
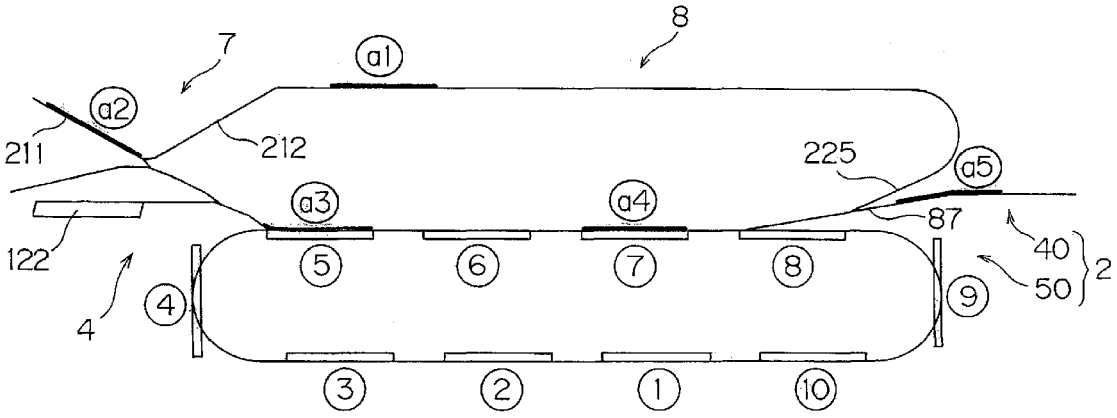
FIG. 19 is an explanatory diagrams schematically illustrating the image recording operation by the image recording device according to the present invention.

Further, when the image recording operation is continued, as illustrated in FIG. 19, the first sheet of printing paper a1 is transported toward the flow part 50 by the transport mechanism 8. Also, the second sheet of printing paper a2 is transported to the fifth conveyer 211 of the inversion part 7. Further, the third sheet of printing paper a3 is transported with being attached onto the fifth table 1. A fourth sheet of printing paper a4 is transported with being attached onto a seventh table 1, and then recorded with the image by the recording heads 22, 23, 24, and 25 in the image recording part 3. Also, a size of the sheet of printing paper a4 is scanned by the scanner 32. Further, a fifth sheet of printing paper a5 is supplied from the sucker part 40.

Figure 20:
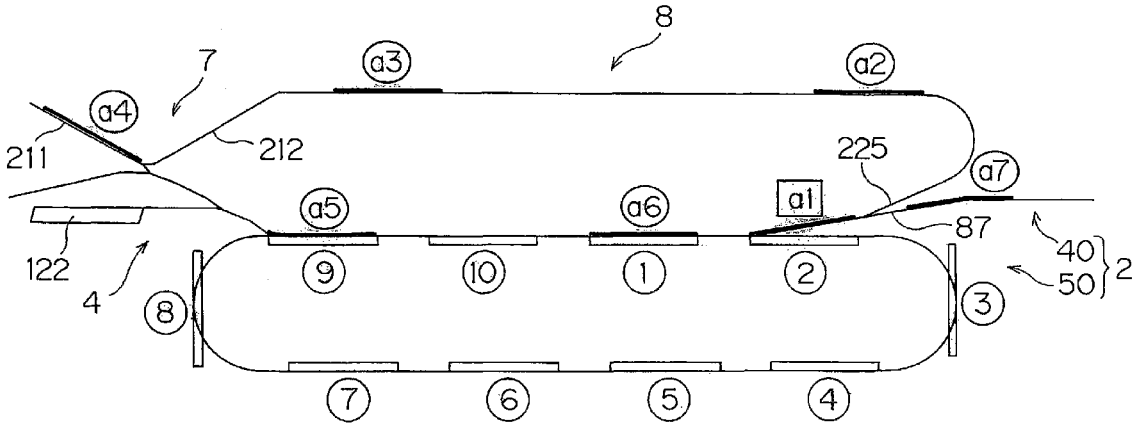
FIG. 20 is an explanatory diagrams schematically illustrating the image recording operation by the image recording device according to the present invention.

Still further, when the image recording operation is continued, as illustrated in FIG. 20, a sixth sheet of printing paper a6 is transported with being attached onto the first table 1, and then recorded with the image by the recording head 22, 23, 24, and 25 in the image recording part 3. Also, a size of the sheet of printing paper a6 is scanned by the scanner 32. Further, in the sucker part 40, a seventh sheet of printing paper a7 is prepared for supply. The seventh sheet of printing paper a7 will be attached onto the third table 1 with bypassing the table 1 subsequent to the first table 1 attached with the sixth sheet of printing paper a1. Then, onto a second table between the first table attached with the sixth sheet of printing paper a6 and the third table 1 onto which the seventh sheet of printing paper 7*a* will be attached, the first sheet of printing paper a1 having been recorded with the front surface image is attached.

The first sheet of printing paper a1 having been recorded with the front surface image is inverted by the inversion part 7, and the front and reverse surfaces thereof are replaced by each other with a back end thereof serving as a front end. The first sheet of printing paper a1 is continuously recorded with an image on the reverse surface thereof by the recording heads 22, 23, 24, and 25 in the image recording part 3. At this time, depending on the size of the sheet of printing paper scanned by the scanner 32, an image recording position by the recording heads 22, 23, 24, and 25 is adjusted.

Figure 21:
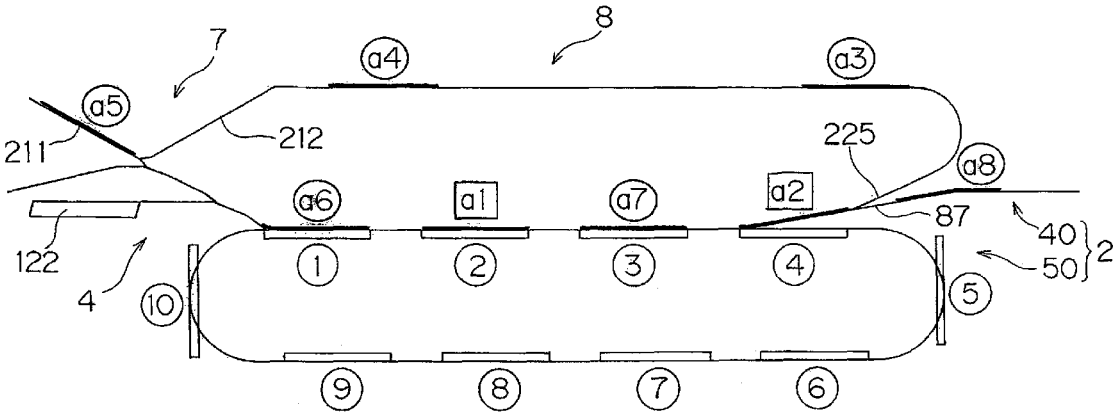
FIG. 21 is an explanatory diagrams schematically illustrating the image recording operation by the image recording device according to the present invention.
Figure 22:
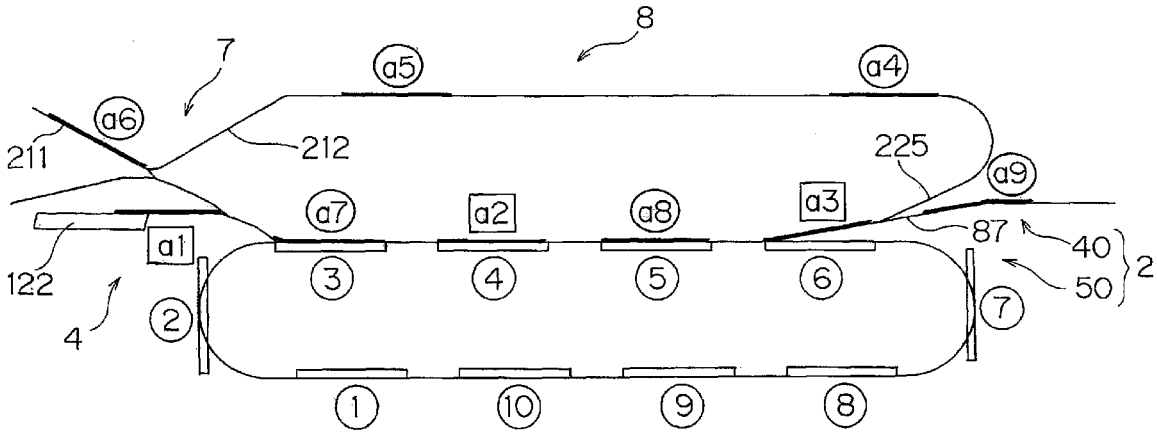
FIG. 22 is an explanatory diagrams schematically illustrating the image recording operation by the image recording device according to the present invention.

Yet further, when the image recording operation is continued, as illustrated in FIG. 21, sheets of printing paper a having been printed with the image on front surfaces thereof and sheets of printing paper a recorded with no image are alternately attached onto the tables 1, and image recording on front surfaces of the sheets of printing paper a and image recording on reverse surfaces of the sheets of printing paper a are alternately performed by the image recording part 3. Then, as illustrated in FIG. 22, the first sheet of printing paper a1 of which both of the surfaces have been recorded with the images is discharged to the stocker part 122 of the paper discharge part 4.

Figure 23:
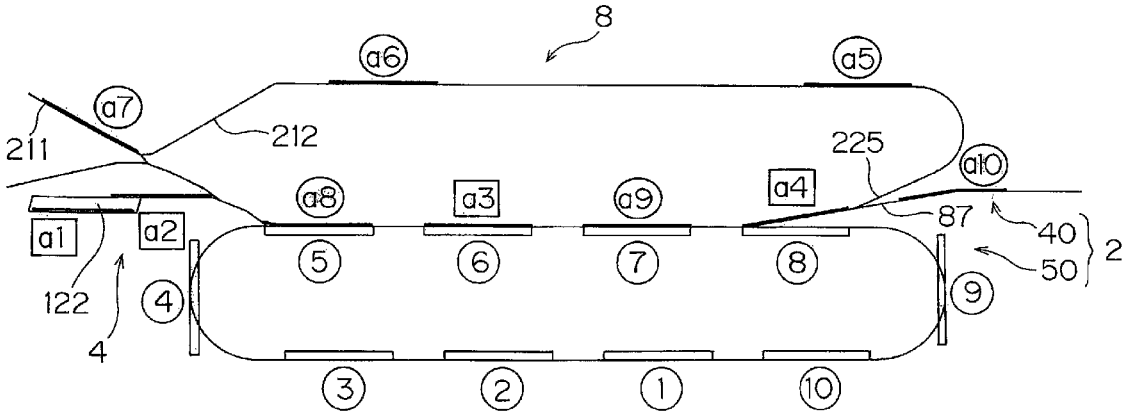
FIG. 23 is an explanatory diagrams schematically illustrating the image recording operation by the image recording device according to the present invention.

Further, when the image recording operation is continued, as illustrated in FIG. 23, the second sheet of printing paper a2 of which both surfaces have been subsequently recorded with the images is discharged to the stocker part 122 of the paper discharge part 4. As described, the sheets of printing paper a each of which both surfaces have been recorded with the images are sequentially discharged to the stocker part 122 of the paper discharge part 4. On the other hand, the sheets of printing paper a each of which only a front surface has been recorded with the image are sequentially transported to the flow part 50 through the transport mechanism 8, and printing on reverse surfaces thereof is performed. When the images are recorded on the reverse surfaces, as described above, depending on sizes of the sheets of printing paper a scanned by the scanner 32, image recording positions by the recording heads 22, 23, 24, and 25 are adjusted.

Note that, in the above-described embodiment, at timing twice timing when sheets of printing paper a are supplied to all of the tables 1 to be sequentially transported, the sheets of printing paper a are intermittently supplied to the tables 1. On the other hand, in the state before the start of the reverse surface printing (as illustrated in FIG. 20, in the state before the first sheet of printing paper a1 having been recorded with the front surface image reaches the flow part 50), the sheets of printing paper a may be supplied at the timing when the sheets of printing paper a are supplied to all of the tables 1 to be sequentially transported. Also, in the image recording device, in the case of recording an image only on one surfaces of the sheets of printing paper a, the sheets of printing paper a are also supplied at the timing when the sheets of printing paper a are supplied to all of the tables 1 to be sequentially transported.

For this reason, preferably the paper supply sucker 82 of the sucker part 40 can switch between supply operation that supplies the sheets of printing paper a at the timing when the sheets of printing paper a are supplied to all of the tables 1 to be sequentially transported and supply operation that intermittently supplies the sheets of printing paper a to the tables 1 at the timing twice the timing when the sheets of printing paper a are supplied to all of the tables 1 to be sequentially transported. In order to enable this, the image recording device employs a suction switching mechanism of the paper supply sucker 82.

Figure 24:
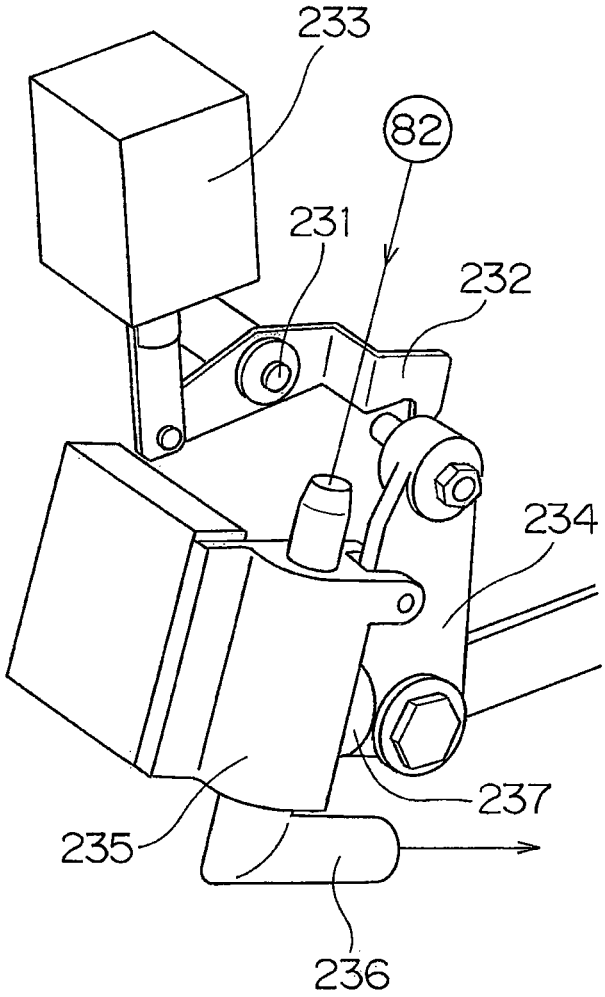
FIG. 24 is a perspective view of a suction switching mechanism.

FIG. 24 is a perspective view of the suction switching mechanism.

The switching mechanism is provided with: a suction valve 235 of which one end is communicatively connected to the paper supply sucker 82 illustrated in FIGS. 3 and 14 and the other end is communicatively connected to an exhaust mechanism through a tube 236; and a lever 234 that swings with respect to the suction valve 235 to thereby open/close a valve 237 coming into abutting contact with the suction valve 235. The lever 234 swings by action of a hook 232 that is swung around a shaft 231 by driving by a solenoid 233. On the other hand, the paper supply sucker 82 communicatively connected to the suction valve 235 swings at the timing when the sheets of printing paper a are supplied to all of the tables 1 to be sequentially transported.

In the case where the paper supply sucker 82 of the sucker part 40 performs the supply operation that supplies the sheets of paper a at the timing when the sheets of printing paper a are supplied to all of the tables 1 to be sequentially transported, as illustrated in FIG. 24, the suction valve 235 is constantly closed. On the basis of this, the paper supply sucker 82 illustrated in FIGS. 3 and 14 suctions the sheet of printing paper a for every swing operation for paper supply to perform the supply operation that supplies the sheets of paper a at the timing when the sheets of printing paper a are supplied to all of the tables 1 to be sequentially transported.

On the other hand, in the case of performing the supply operation that intermittently supplies the sheets of printing paper a to the tables 1 at the timing twice the timing when the sheets of printing paper a are supplied to all of the tables 1 to be sequentially transported, when the paper supply sucker 82 performs the swing operation for supplying the sheets of printing paper a, it alternately opens and closes the suction valve 235. On the basis of this, the paper supply sucker 82 suctions and holds the sheet of printing paper a only in one of two swing operations, and thereby performs the supply operation that intermittently supplies the sheets of printing paper a to the tables 1 at the timing twice the timing when the sheets of printing paper a are supplied to all of the tables 1 to be sequentially transported.

Figure 25:
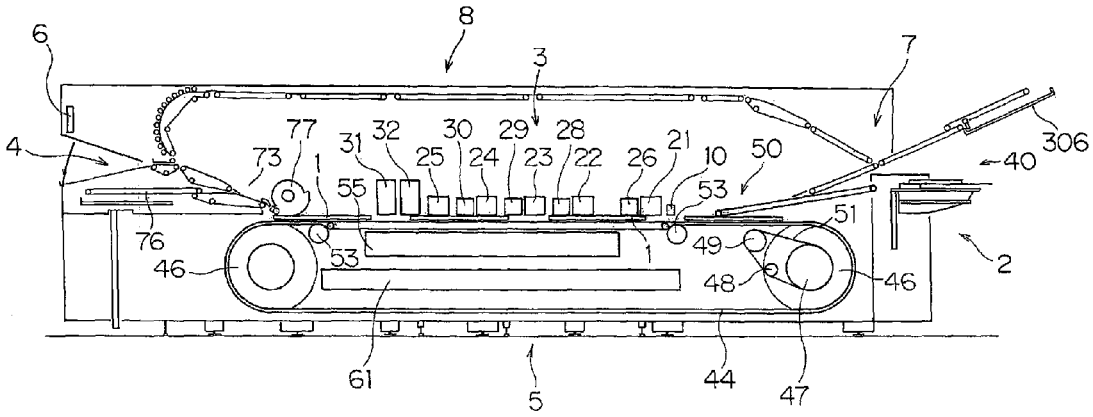
FIG. 25 is a schematic side view of an image recording device according to a second embodiment of the present invention.
Figure 26:
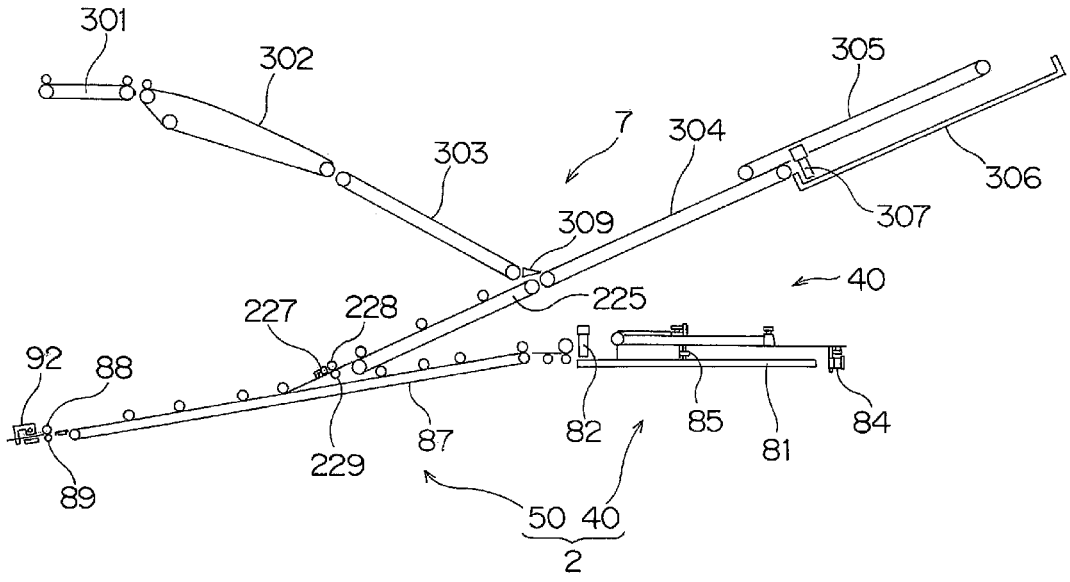
FIG. 26 is a side view of the vicinity of a paper supply part 2 and an inversion part 7 of the image recording device according to the second embodiment of the present invention.
Figure 27:
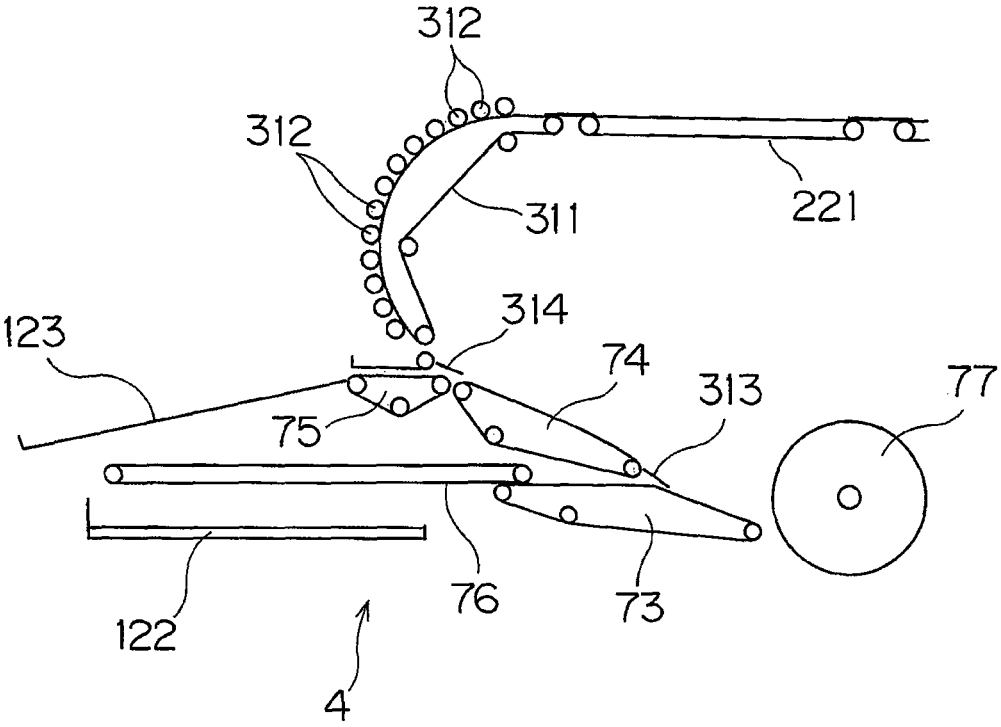
FIG. 27 is a side view of the vicinity of a paper discharge part 4 according to the second embodiment of the present invention.
Figure 28:
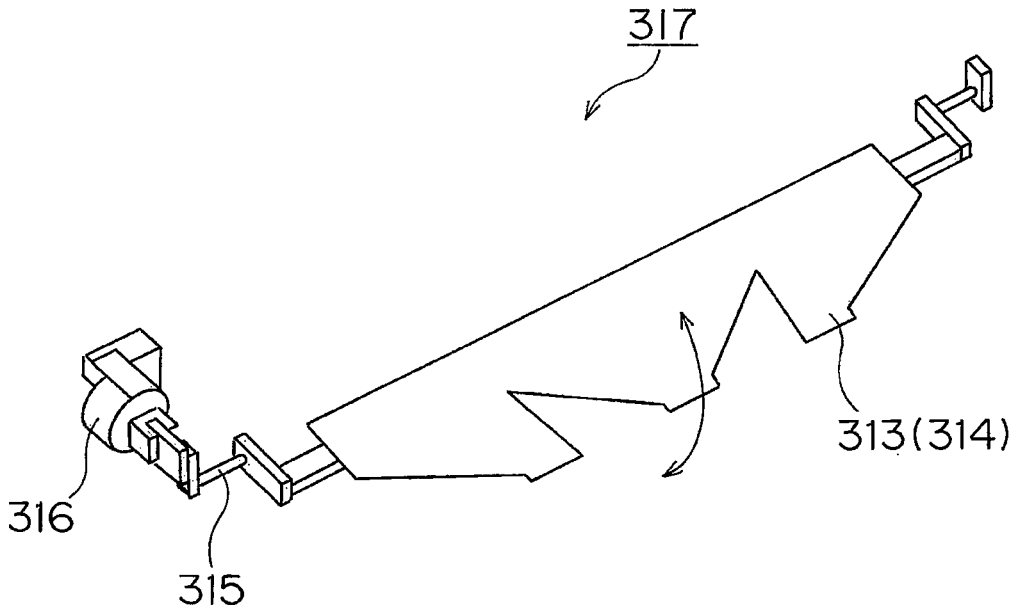
FIG. 28 is a perspective view of a transport path switching mechanism 317.

Next, another embodiment of the present invention is described. FIG. 25 is a schematic side view of an image recording device according to a second embodiment of the present invention. Also, FIG. 26 is a side view of the vicinity of a paper supply part 2 and an inversion part 7 of the image recording device, and FIG. 27 is a side view of the vicinity of a paper discharge part 4. Further, FIG. 28 is a perspective view of a transport path switching mechanism 317. Note that the same members as those in the above-described first embodiment are denoted by the same symbols, and detailed description of them is omitted.

In the image recording device according to the above-described first embodiment, the inversion part 7 is arranged in the same direction as the paper discharge part 4. On the other hand, the image recording device according to the second embodiment has a configuration in which the inversion part 7 is arranged in the same direction as a flow part 50 as a recording medium attachment part, and also a stocker part 306 that temporarily stocks a sheet of printing paper a of which single-surface printing is complete, and a paper supply sucker 307 and a conveyer 304 that transport the sheet of printing paper a temporarily stocked in the stocker part 306 to the flow part 50 are disposed adjacent to the inversion part 7.

That is, as illustrated in FIG. 27, in the image recording device according to the second embodiment, by action of a path switching plate 313 disposed between a first conveyer 72 and a third conveyer 74, it is determined whether or not the sheet of printing paper a having been recorded with an image is discharged to a stocker part 122 through a second conveyer 76. Also, by action of a path switching plate 314 disposed between the third conveyer 74 and a fourth conveyer 75, it is determined whether or not the sheet of printing paper a is discharged to a paper discharge table 123. Note that, as illustrated in FIG. 28, the path switching plates 313 and 314 swing around a shaft 315 by action of a solenoid 316.

Also, a sheet of printing paper discharged to neither the stocker part 122 nor the paper discharge table 123 is transported to a conveyer 221 of a transport mechanism 8 by a plurality of rollers 312 and an endless belt 311.

As illustrated in FIG. 26, the sheet of printing paper a that has been recorded on one surface thereof with the image and transported by the conveyer 221 of the transport mechanism 8 is transported onto a conveyer 304 through conveyers 301, 302, and 303. If image recording is immediately performed on a reverse surface of the sheet of printing paper a, by switching a direction switching lever 309 that is the same as the direction switching lever 213 or 214 illustrated in FIG. 13, the sheet of printing paper a is inverted on the basis of the switch back method, and then transported toward a conveyer 225. Then, in the same manner as in the case of the above-described first embodiment, the sheet of printing paper a is transported onto a table 1 through the conveyer 225 and a conveyer 87.

On the other hand, a sheet of printing paper a to be temporarily stocked in the stocker part 306 is transported from the conveyer 304 to a conveyer 305, and then transported to a position above the stocker part 306 with being suctioned and held by the conveyer 305. Then, the sheet of printing paper a is blown with air toward a central part thereof by the same mechanism as the air blowing tube 162 illustrated in FIG. 7; released from the suctioning/holding by the conveyer 305; and stocked in the stocker part 306. The sheet of printing paper a stocked in the stocker part 306 is positioned in a direction orthogonal to a transport direction of the sheet of printing paper a by the same needle mechanism as that 100 illustrated in FIG. 4.

In the case of recording an image on the sheet of printing paper a stocked in the stocker part 306, one end of the sheet of printing paper a stocked in the stocker part 306 is suctioned and held by a paper supply sucker 307, and the sheet of printing paper a is transported onto the conveyer 304. Then, the direction switching lever 309 is switched to transport the sheet of printing paper a from the conveyer 304 toward the conveyer 225, and in the same manner as in the case of the above-described first embodiment, the sheet of printing paper a is transported onto the table 1 through the conveyers 225 and 87.

According to the image recording device according to the second embodiment, an inverted sheet of printing paper a can be temporarily stocked in the stocker part 306, and then again transported onto the table 1. For this reason, in the case of performing double surface printing on a small amount of printing paper, or in other case, by continuously supplying sheets of printing paper a onto the tables 1 to perform single-surface printing on front surfaces of the sheets of printing paper a; once stocking the sheets of printing paper a in the stocker part 306; then again performing single-surface printing on reverse surfaces of the sheets of printing paper a, a time necessary to transfer an image can be shortened to thereby efficiently perform printing. For this reason, in the image recording device according to the second embodiment, low-volume high-mix double-surface printing, or the like can be efficiently performed.

EXPLANATIONS OF REFERENCE NUMERALS

1: Table
2: Paper supply part
3: Image recording part
4: Paper discharge part
5: Table movement mechanism
6: GUI
7: Inversion part
8: Transport mechanism
21: Preprocessing agent coating head
22: Recording head
23: Recording head
24: Recording head
25: Recording head
32: Scanner
40: Sucker part
44: Chain
46: Sprocket
47: Sprocket
48: Drive sprocket
50: Flow part
51: Chain
52: Sprocket
53: Sprocket
55: Suction fan
61: Linear motor mechanism
77: Paper discharging drum
82: Paper supply sucker
200: Control part
211: Fifth conveyer
212: Sixth conveyer
213: Direction switching lever
214: Direction switching lever
221: Conveyer
227: Fore registering part
235: Suction valve
304: Conveyer
305: Conveyer
306: Sucker part
307: Sucker
a: Printing paper

What is claimed is:

1. An image recording device that records images on a front surface and a reverse surface of a recording medium, the image recording device comprising:

recording medium holding means that holds the recording medium;

a movement mechanism that moves the recording medium holding means;

a recording medium attachment part that attaches the recording medium to the recording medium holding means that is moved by driving by the movement mechanism;

a recording medium supply part that supplies the recording medium not recorded with an image to the recording medium attachment part;

a recording head that records an image on the recording medium that is attached to the recording medium holding means by the recording medium attachment part and held by the recording medium holding means;

a detection part that detects a size of the recording medium of which the front surface is recorded with the image by the recording head;

an inversion part that inverts, on a basis of a switch back method, the recording medium of which the front surface is recorded with the image by the recording head, such that a front end of the recording medium serves as a back end;

a recording medium transport mechanism that transports the recording medium inverted by the inversion part to the recording medium attachment part;

a control part that adjusts, on a basis of the size of the recording medium, the size being detected by the detection part, an image recording position on the reverse surface of the recording medium by the recording head; and a recording medium discharge part that discharges the recording medium of which the front surface and the reverse surface are recorded with the images by the recording head.

2. The image recording device according to claim 1, wherein the recording medium holding means is a plurality of tables that support the recording media, and the tables move along a circulation path with use of: a pair of roller members; a drive mechanism that rotationally drives the pair of roller members; and an endless transport mechanism that has an endless rope body wound on the pair of roller members.

3. The image recording device according to claim 2, wherein the recording medium attachment part alternately attaches to the plurality of tables a recording medium not recorded with an image and a recording medium of which a front surface is recorded with an image.

4. The image recording device according to claim 3, wherein the recording medium supply part intermittently supplies the recording medium not recorded with an image to the recording medium attachment part; and the recording medium transport mechanism transports, between the recording media not recorded with an image, the recording media being intermittently supplied by the recording medium supply part, the recording medium of which a front surface is recorded with an image.

5. The image recording device according to claim 2, wherein the recording medium attachment part is provided with a positioning mechanism that comes into abutting contact with a front end of a recording medium to position the recording medium.

6. The image recording device according to claim 2, wherein the detection part is a scanner that scans the image recorded by the recording head or a detection patch.

7. The image recording device according to claim 2, wherein the inversion part is arranged in a same direction as the paper discharge part.

8. The image recording device according to claim 2, wherein the inversion part is arranged in a same direction as the recording medium attachment part, and a stocker part that temporarily stocks a recording medium on which single-surface printing is complete, and a transport mechanism that transports the recording medium temporarily stocked by the stocker part to the recording medium attachment part are disposed adjacent to the inversion part.

* * * * *

UNITED STATES PATENT AND TRADEMARK OFFICE

CERTIFICATE OF CORRECTION

PATENT NO. : 8,579,286 B2
APPLICATION NO. : 12/936118
DATED : November 12, 2013
INVENTOR(S) : Hirai et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 556 days.

Signed and Sealed this
Twenty-second Day of September, 2015

Michelle K. Lee

Michelle K. Lee
*Director of the United States Patent and Trademark Office*